US005495818A

United States Patent [19]

Woodcock

[11] Patent Number: 5,495,818

[45] Date of Patent: Mar. 5, 1996

[54] SHROUD SLAP STOPPING MECHANISM

[76] Inventor: Carl H. Woodcock, 663 E. Bay Ave., Barnegat, N.J. 08005

[21] Appl. No.: 478,956

[22] Filed: Jun. 7, 1995

[51] Int. Cl.[6] ..... B63H 9/04

[52] U.S. Cl. ..... 114/111; 114/103; 114/90

[58] Field of Search ..... 242/157 R, 615.3, 242/147 R; 114/39.1, 102, 103, 111, 89, 90, 114, 109, 108; 116/173, 174

[56] References Cited

U.S. PATENT DOCUMENTS 3,918,383 11/1975 Brown ..... 114/102
4,157,073 6/1979 Vall ..... 114/111
5,113,776 5/1992 Knecht ..... 114/39.1
5,315,955 5/1994 Feliz ..... 116/173

*Primary Examiner*—Edwin L. Swinehart
*Attorney, Agent, or Firm*—Brumbaugh, Graves, Donohue & Raymond

[57] ABSTRACT

Apparatus to stop the slapping of halyards against a mast includes a ring or other halyard encircling member lightly engagable with the halyard. A cleat or other line securing member is affixed to a shroud located outboard of the mast and halyards. A pulley or other line entraining means is affixed to the halyard above the line securing member. A line is tied to the ring entrained outward through the pulley and downward to the cleat where it is tied. Light tension in the line is sufficient to prevent halyard slap as a result of interruption of the resonance of the halyard.

11 Claims, 1 Drawing Sheet

SHROUD SLAP STOPPING MECHANISM

BACKGROUND OF THE INVENTION

This invention relates to apparatus for the prevention of sailboat rigging slapping and more particular to an apparatus that prevents the slapping of a halyard against a mast.

The annoying sound of halyards slapping against a mast has plagued sailors since time immemorial. Numerous attempts at a solution have been jury-rigged in an effort to, for example, allow a full night's sleep aboard. Sailors have been known to insert any number of items between the mast and the halyard to hold the halyard away from the mast, but of course, such a solution is only temporary inasmuch as any such insert must be removed to allow free use of the halyards to set and lower the sails.

Similarly, halyards have been tied tightly away from the mast by, for example, a line stretched to a shroud, but again this is not a permanent solution because this arrangement too interferes with the required longitudinal movement of the halyards.

BRIEF SUMMARY OF THE INVENTION

In accordance with this invention a member engaging a rigging line such as a halyard permits that line's free movement in its ordinary use and prevents its slapping. The line-engaging member is drawn lightly away from the mast by a line that reaches to a nearby shroud. The line engaging member, which can be a simple brass or stainless steel ring, need apply only a small force, of the nature of a few ounces, to interrupt the resonant movement to and from the mast of those rope or cable halyards that stretch the length of the mast.

In a preferred embodiment, a shroud cleat is affixed to a shroud within easy reach of the deck. A shroud clamp retains a small pulley on the shroud above the shroud cleat just below a spreader. A light line runs upward from the cleat, where it is tied, and proceeds through the pulley. The light line extends toward the mast and terminates in a ring encircling a halyard or halyards. The pulley entrains the light line laterally away from the mast and determines where the ring engages the halyard. Applied by tieing the light line to the cleat, surprisingly light tension in the line will be adequate to disrupt the resonant movement of the halyard that causes slapping. The ring may be brass or stainless stain. Because the ring only lightly touches a halyard, ordinary operation of the rigging is no way impaired. Again because of the lightness with which it touches the halyards, the ring is subject to negligible abrasion by the running of the halyards through it, and conversely, the halyards show little or no wear as a result of the presence of the ring.

BRIEF DESCRIPTION OF THE DRAWINGS

The above and further objects and advantages of the invention will be better understood from the following detailed description of a preferred embodiment taken in consideration with the accompanying drawings, in which.

DESCRIPTION OF PREFERRED EMBODIMENT

Figure 1:
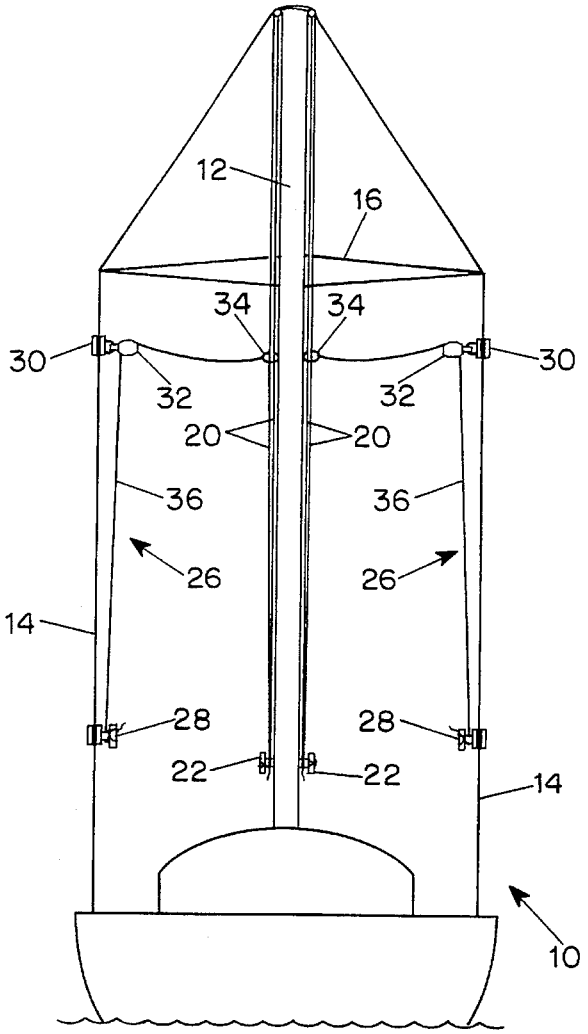
FIG. 1 is a diagrammatical illustration of a boat equipped with a halyard slap interrupting arrangement according to this invention.

In FIG. 1 a sailboat 10 has a mast 12 secured by cable shrouds 14 that are spread at a spreader 16 as is conventional. The shrouds are a normal part of the "standing rigging," normally not adjusted while underway Rope or cable halyards 20 run along the mast and are secured at cleats 22, again conventionally. The halyards are rigging lines that are a part of the "running rigging," which is normally adjusted underway. They must move to set and lower sails.

The extension of the halyards from the top of the mast to the cleats 22 establishes a resonance in these rigging lines that ordinarily results in the familiar slapping against the mast in almost any wind.

Figure 4:
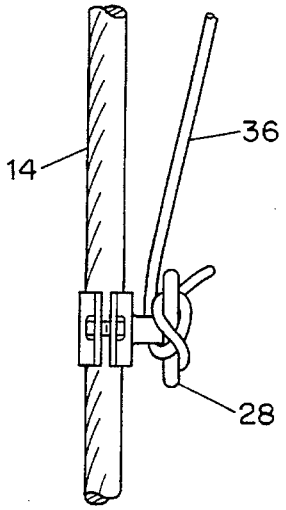
FIG. 4 is a further enlarged fragmentary illustration of the line of FIG. 2 secured to a shroud cleat.

In accordance with this invention two arrangements 26, one on each side of the mast, interrupt the resonance of the halyards to prevent slapping, Each of these arrangements 26 includes a shroud cleat 28, illustrated in greater detail in FIG. 4, located on the shroud 14 within easy reach of the deck of the boat. A shroud clamp 30 secures a small pulley 32 to the shroud 14 at a point approximately 6" below the spreader 16. A ring 34 encircles the halyards 20 and is secured to the end of a light line 36. The line 36 extends from the ring, through the pulley 32, to the cleat 28, where it is tied. The line 36 may be ⅛" to 3/16" nylon or dacron line depending on the size of the halyards being restrained.

Figure 2:
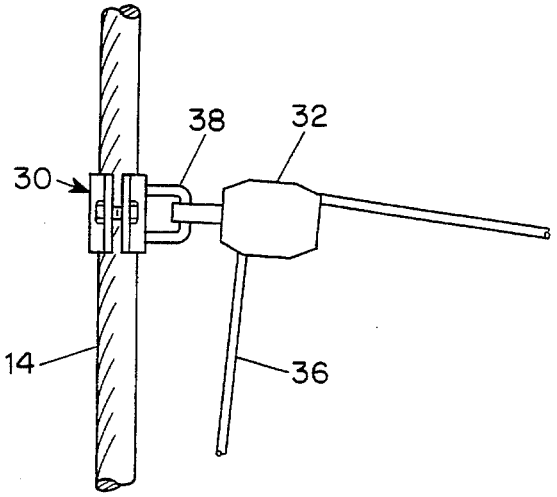
FIG. 2 is an enlarged fragmentary illustration of a pulley secured to a shroud and entraining a line that is used in the arrangement according to FIG. 1.

FIG. 2 illustrates the pulley 32 and shroud clamp 30 in greater detail. The clamp 30, which is known in the art, secures a staple 38, or other fastener, coupled to the pulley 32.

Figure 3:
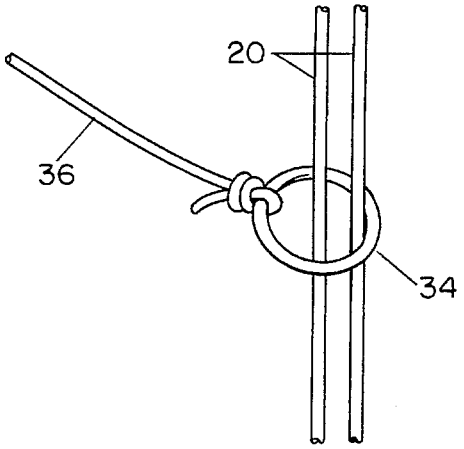
FIG. 3 is a further enlarged fragmentary illustration of a ring at the end of the line illustrated in FIG. 2 and in encircling relation to a pair of halyards.

The ring 34, its light engagement with one or more of the halyards 20, and its connection to the end of the line 36 is shown best in FIG. 3. The ring 34 can be brass or stainless steel and, although clearly a pulley 32 might be employed, because of the very light engagement of the ring with the halyards, negligible abrasion occurs as the halyards are run through the ring in the ordinary operation of the sails.

Figure 5:
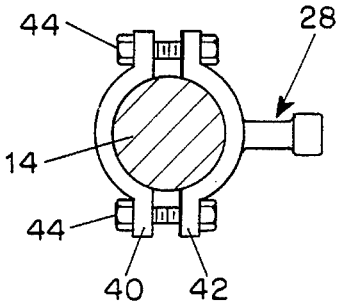
FIG. 5 is an enlarged fragmentary cross-sectional view of a shroud clamp of a kind suitable to retain the shroud cleat or the pulley of FIGS. 4 and 2.

The shroud cleat 28 affixed to the shroud 14 and securing the line 36 provides a means for securing the line 36 at a fixed location on the boat. It is best seen in FIG. 4. The shroud cleat 28 is a commercially available item. The manner of attachment of the shroud clamp and the shroud cleat to the shroud is better illustrated in FIG. 5. There, the shroud cleat 28 is shown attached to the shroud 14. Two halves 40 and 42 of a clamp embrace the shroud 14 and are connected together by fasteners 44. The manner of securing the clamp 30 is similar.

Installation and operation are simple. The pulley 32 is attached to the shroud 14 as shown. The ring 34 is secured to one end of the line 36 and the free end of the line is fed down through the pulley 32.

The ends of the boat's halyards on one side of the mast are fed through the ring 34 and returned to their normal points to be secured at a cleat 22. All of the boat's rigging is then set as normal. The free end of the line 36 is then pulled down to provide the slight amount of tension. At this point, the line 36 is secured to the shroud-mounted cleat, located within easy reach of the deck.

The arrangement in no way alters the normal operation of the boat's rigging. The effect is to change the resonant frequency of the halyards, or for that matter any long ropes running the length of the mast. The arrangement makes only the slightest amount of change in the tension and angle of the rigging.

Although a specific preferred embodiment of the invention has been described above, it will be recognized by those skilled in the art that modifications and alterations can be made without departure from the spirit and scope of the invention, which invention is described in the appended claims.

I claim:

1. Apparatus for preventing the slapping of a movable rigging line against a mast, along which the rigging line extends, including:

a member for movably engaging the movable rigging line intermediate the ends of the run thereof along the mast, a further line connected to the movably engaging member, and means directing the further line laterally away from the mast under light tension, whereby the rigging line is freely movable longitudinally without interference from the movably engaging member.

2. Apparatus according to claim 1 wherein the means directing the further line laterally away from the mast under light tension includes means for entraining the further line at a position laterally removed from the mast and determining by its position the location of engagement of the movable member with the rigging line, and means for applying the light tension along the further line in opposition to movement of the rigging line toward the mast sufficient to interrupt resonant movement of the rigging line to and from the mast.

3. Apparatus according to claim 2 wherein the means for applying a force along the further line is a line securing member adapted to be mounted at a fixed on-board location.

4. Apparatus according to claim 2 wherein the means for entraining is a line-guiding means adapted for attachment to a further, stationary rigging line laterally removed from the mast and the first mentioned rigging line.

5. Apparatus according to claim 2 wherein the means for applying the light tension along the further line is a line securing member adapted to be mounted at a fixed on-board location.

6. Apparatus according to claim 5 wherein the line securing member is adapted for attachment to the further, stationary rigging line downward from the line-guiding means.

7. Apparatus according to claim 6 wherein the member for movably engaging the rigging line is a ring secured to the end of the further line for encircling the rigging line and allowing lengthwise movement of the rigging line therethrough.

8. Apparatus according to claim 6 wherein the line-guiding means is a pulley securable to the further, stationary rigging line.

9. Apparatus according to claim 8 wherein the pulley has a shroud clamp for securing the pulley to the further, stationary rigging line.

10. Apparatus according to claim 6 wherein the line securing member has a clamping means for affixing the line securing member to the further stationary rigging line.

11. Apparatus for the prevention of the slapping of a halyard against a mast including a line securing member affixed to a shroud, a line entraining member affixed to the shroud above the line securing member, a line tied to the line securing member and entrained upward generally parallel to the shroud and through the line entraining member, the line extending towards the halyard and to a halyard encircling means lightly engaging the halyard and effective to interrupt resonation of the halyard.

* * * * *

UNITED STATES PATENT AND TRADEMARK OFFICE

CERTIFICATE OF CORRECTION

PATENT NO. : 5,495,818
DATED : March 5, 1996
INVENTOR(S) : Carl H. Woodcock

It is certified that error appears in the above-indentified patent and that said Letters Patent is hereby corrected as shown below:

Col. 1, line 48, "stainless stain" should read --stainless steel--;

Col. 2, line 16, "underway Rope" should read --underway. Rope--.

Signed and Sealed this

Seventh Day of January, 1997

*Attest:*

Bruce Lehman

BRUCE LEHMAN

*Attesting Officer*

*Commissioner of Patents and Trademarks*